US011752588B2

(12) United States Patent
Liu et al.

(10) Patent No.: US 11,752,588 B2
(45) Date of Patent: Sep. 12, 2023

(54) FLEXIBLE AUTOMATIC DEBURRING DEVICE

(71) Applicant: CITIC Dicastal CO., LTD., Qinhuangdao (CN)

(72) Inventors: Xiao Liu, Qinhuangdao (CN); Shouyan Shang, Qinhuangdao (CN); Siyang Fan, Qinhuangdao (CN)

(73) Assignee: CITIC Dicastal CO., LTD., Qinhuangdao (CN)

( * ) Notice: Subject to any disclaimer, the term of this patent is extended or adjusted under 35 U.S.C. 154(b) by 979 days.

(21) Appl. No.: 16/676,693

(22) Filed: Nov. 7, 2019

(65) Prior Publication Data

US 2020/0384594 A1 Dec. 10, 2020

(30) Foreign Application Priority Data

Jun. 6, 2019 (CN) ..... 201910490315.1

(51) Int. Cl.
*B24B 5/44* (2006.01)
*B24B 41/06* (2012.01)

(52) U.S. Cl.
CPC ..... *B24B 5/44* (2013.01); *B24B 41/06* (2013.01)

(58) Field of Classification Search
CPC ..... B24B 29/005; B24B 9/005; B24B 9/002; B24B 9/04; B24B 21/006; B24B 5/40; B24B 5/48; B24B 27/033; B24B 5/44; B24B 41/06; B24B 41/02; B24D 13/10; B24D 13/145
See application file for complete search history.

(56) References Cited

U.S. PATENT DOCUMENTS 2,113,742 A * 4/1938 Phelps ..... A46B 9/06 15/93.1
10,112,282 B2 * 10/2018 Xue ..... B24B 5/44
10,160,085 B2 * 12/2018 Xue ..... B24B 29/04
10,232,486 B2 * 3/2019 Xue ..... B24D 13/145
10,232,490 B2 * 3/2019 Xue ..... B24B 29/04

* cited by examiner

*Primary Examiner* — Brian D Keller
*Assistant Examiner* — Dana Lee Poon
(74) *Attorney, Agent, or Firm* — IPRO, PLLC

(57) ABSTRACT

The disclosure relates to the technical field of deburring in machining, in particular to a flexible automatic deburring device, comprising a main body support, a lifting assembly, a rotary burr brushing assembly and positioning and clamping assemblies. The lifting assembly can move up and down to adapt to inner cavities of workpieces with different depths, springs are arranged on the bottom surfaces of brush holders, so that brushes can float up and down to adapt to hubs with different spoke inner cavity shapes, and it is guaranteed that the brushes make contact with spoke inner cavities all the time; in this way, hubs with the same size but different shapes can use the same brush mechanism, it is unnecessary to prepare brushes suitable for all wheel types, thus greatly reducing the workload of replacing deburring brushes, saving the storage space in a workshop and increasing the burr brushing flexibility.

10 Claims, 3 Drawing Sheets

FLEXIBLE AUTOMATIC DEBURRING DEVICE

CROSS-REFERENCE TO RELATED APPLICATION

The present application claims benefit of Chinese Patent Application No. 201910490315.1, entitled "Flexible Automatic Deburring Device", filed on Jun. 6, 2019, the content of which is hereby incorporated by reference in their entirety.

TECHNICAL FIELD

The disclosure relates to the technical field of deburring in machining, in particular relates to a flexible automatic deburring device.

BACKGROUND

General hub processing technology includes three main processes, namely, casting, machining and coating. After the machining process, there are a large number of burrs on a hub, and if the burrs are not completely removed, electric leakage will occur and the appearance and protection effect after coating will be affected. Burrs are mainly generated at the intersection of a machining surface and a casting surface. Parts like spoke windows, bolt holes, and valve holes are the main locations where burrs are generated, among which spoke windows have the most and largest burrs, thus requiring special attention. At present, a large number of deburring brushes with different sizes and shapes are stored in the workshop of hub manufacturers for the deburring process, resulting in the problems of wasting storage space, increasing the workload of replacing brushes, low automation level and the like.

SUMMARY

The embodiment of the disclosure provides a flexible automatic deburring device, which solves the problems in the prior art and can realize flexible automatic deburring of hubs with the same size but different shapes, thus greatly reducing the workload of replacing deburring brushes, saving the storage space in a workshop and increasing the burr brushing flexibility.

In order to achieve the above purpose, the disclosure provides the following technical solution: In the first aspect, a deburring device is provided, comprising a main body support, a lifting assembly, a rotary burr brushing assembly and positioning and clamping assemblies, wherein the lifting assembly is fixed at the bottom of the main body support, the rotary burr brushing assembly is fixed at the upper end of the lifting assembly, and the lifting assembly can drive the rotary burr brushing assembly to move up and down in the vertical direction to adapt to inner cavities of workpieces with different depths; the rotary burr brushing assembly comprises a rotating assembly, a fixing plate, springs, brush holders and brushes, the rotating assembly is fixed at the upper end of the lifting assembly, the fixing to plate is fixed at the upper end of the rotating assembly, and the rotating assembly drives the fixing plate to rotate; the brushes are fixed in the brush holders, the brush holders are fixed on the fixing plate, and the springs are arranged between the bottom surfaces of the brush holders and the fixing plate; when the brushes are subjected to pressure, the brush holders move down in the vertical direction and compress the springs; one or more groups of brush holders are arranged, each group includes a plurality of brush holders, and the plurality of brush holders in each group are closely arranged in the radial direction of the circumference of a workpiece; the plurality of positioning and clamping assemblies are uniformly arranged on the top circumference of the main body support, and the positioning and clamping assemblies are configured to position the workpiece on the main body support and clamp the workpiece. According to the above solution, a lifting assembly can move up and down to adapt to inner cavities of workpieces with different depths, springs are arranged on the bottom surfaces of brush holders, so that brushes can float up and down to adapt to hubs with different spoke inner cavity shapes, and it is guaranteed that the brushes make contact with spoke inner cavities all the time; in this way, hubs with the same size but different shapes can use the same brush mechanism, and it is unnecessary to prepare brushes suitable for all wheel type.

In some embodiments, wherein the rotating assembly comprises a motor, a speed reducer and a connecting plate, the lower end of the motor is fixed at the upper end of the lifting assembly, and the output end of the motor is connected with the speed reducer; the connecting plate is fixedly mounted at the output end of the speed reducer, the fixing plate is fixed on the connecting plate, and the motor drives the connecting plate and the fixing plate to rotate through the speed reducer; the rotary burr brushing assembly further comprises positioning posts, a through hole is formed in the bottom surface of each brush holder, the positioning posts pass through the through holes in the bottom surfaces of the brush holders, to the lower ends of the positioning posts are fixed on the fixing plate, and the parts, positioned between the bottom surfaces of the brush holders and the fixing plate, of the positioning posts are sleeved with the springs. In the above solution, positioning posts are arranged to ensure that the brushes do not swing left and right when floating up and down, and it is guaranteed that the brushes are in contact with the spoke inner cavities all the time, thus ensuring the burr brushing effect.

In some embodiments, wherein the fixing plate and the connecting plate are correspondingly and uniformly provided with lightening holes. The arrangement of lightening holes greatly reduces the overall weight of the equipment, so that a rotating motor can use less power, thus saving more energy.

In some embodiments, wherein the lifting assembly comprises a vertical lifting part and a lifting plate, the vertical lifting part is fixed on the bottom of the main body support, the lifting plate is fixed to the upper end of the vertical lifting part, and the lifting plate can move up and down inside the main body support under the action of the vertical lifting part. A vertical lifting part in this embodiment may be an air cylinder, a hydraulic cylinder or an electric cylinder.

In some embodiments, wherein the main body support comprises a base plate, four upright posts, an intermediate plate and a base, the base plate, the intermediate plate and the base are all horizontal, and the four upright posts are symmetrically fixed on the base; and the annular base plate is fixed at the upper ends of the four upright posts, the annular intermediate plate is fixed at the middle positions of the four upright posts, a circular hole is formed in the middle of the intermediate plate, and the lower end of the rotating assembly passes through the circular hole in the intermediate plate. In the present embodiment, the overall structure of the main body support is designed to be circular, which facilitates the position setting of positioning and clamping assemblies and the placement of the wheel hub. The circular design enables the middle lifting assembly and a rotary burr brushing assembly to move up and down to adapt to different wheel rim depths.

In some embodiments, wherein the lifting assembly comprises a vertical lifting part and a lifting plate, the vertical lifting part is fixed on the base of the main body support, the lifting plate is fixed to the upper end of the vertical lifting part, and the lifting plate can move up and down inside the main body support under the action of the vertical lifting part. A vertical lifting part in this embodiment may be an air cylinder, a hydraulic cylinder or an electric cylinder.

In some embodiments, wherein one or more first guide posts are further arranged on the circumference of the vertical lifting part on the base, second guide sleeves are arranged on the lifting plate and the intermediate plate at positions corresponding to the first guide posts, the first guide posts are inserted into the second guide sleeves, and the first guide posts and the second guide sleeves move relatively along with the lifting of the vertical lifting part. In the present embodiment, the arrangement of first guide posts and second guide sleeves makes the lifting of the lifting assembly more stable, so that the rotary burr brushing assembly does not deviate and the burr brushing quality is ensured.

In some embodiments, wherein the positioning and clamping assemblies comprise vertical push-pull assemblies, first guide sleeves, second guide posts, supporting seats, first rotating shafts, second rotating shafts and positioning rods, the vertical push-pull assemblies are fixed on the bottom surface of a top face of the main body support, the top face is provided with through holes corresponding to the vertical push-pull assemblies, and output ends of the vertical push-pull assemblies pass through the through holes in the top face and are connected with the second guide posts; the second guide posts are sleeved with the first guide sleeves, and the first guide sleeves are fixed on the upper surface of the top face; the upper ends of the positioning posts are movably connected to one ends of the positioning rods through the second rotating shafts, two supporting seats are symmetrically fixed on the top face of the main body support at two sides of the middle of each positioning rod, and the first rotating shafts penetrate through the upper portions of the two supporting seats and the middle portions of the positioning rods and movably fix the positioning rods on the two supporting seats; when the vertical push-pull assemblies push the second guide posts upwards, the second guide posts push the positioning rods upwards, the positioning rods rotate around the first rotating shafts, and the positioning rods fix and clamp the workpiece; and when the vertical push-pull assemblies pull down the second guide posts, the second guide posts pull down the positioning rods, the positioning rods rotate around the first rotating shafts, and the positioning rods release the workpiece. In the present embodiment, positioning rods can be used for positioning and clamping the wheel by utilizing the lever principle, the structural design of the positioning and clamping assemblies is simple and practical, and each vertical push-pull assembly can be a common assembly such as an air cylinder, a hydraulic cylinder or an electric cylinder.

In some embodiments, wherein the positioning rods are V-shaped positioning rods, a through hole is formed at the turning point of the V shape of each positioning rod, and the first rotating shafts pass through the through holes in the positioning rods and movably fix the positioning rods on the two supporting seats. The V-shaped design makes the end, close to the workpiece, of each positioning rod face upwards, making it easier to place and remove the workpiece.

In some embodiments, wherein four groups of brush holders are fixed on the fixing plate, and the interval between every two adjacent groups of brush holders is 90 degrees. The group number of brush holders can be adjusted and set according to the burr brushing effect, thus increasing the adjustability and practicability of the device.

Compared with the prior art, the disclosure has the following beneficial effects:

The disclosure provides a deburring device, comprising a main body support, a lifting assembly, a rotary burr brushing assembly and positioning and clamping assemblies. The lifting assembly can move up and down to adapt to inner cavities of workpieces with different depths, springs are arranged on the bottom surfaces of brush holders, so that brushes can float up and down to adapt to hubs with different spoke inner cavity shapes, and it is guaranteed that the brushes make contact with spoke inner cavities all the time; in this way, hubs with the same size but different shapes can use the same brush mechanism, it is unnecessary to prepare brushes suitable for all wheel types, thus greatly reducing the workload of replacing deburring brushes, saving the storage space in a workshop and increasing the burr brushing flexibility.

BRIEF DESCRIPTION OF THE DRAWINGS

In order to more clearly explain the technical solution in the embodiments of the present disclosure, drawings which require to be used in description of the embodiments are simply introduced below, obviously, the drawings in description below are some embodiments of the present disclosure, and those having ordinary skill in the art can further acquire other drawings without creative efforts according to those drawings.

REFERENCE NUMERALS

Figure 1:
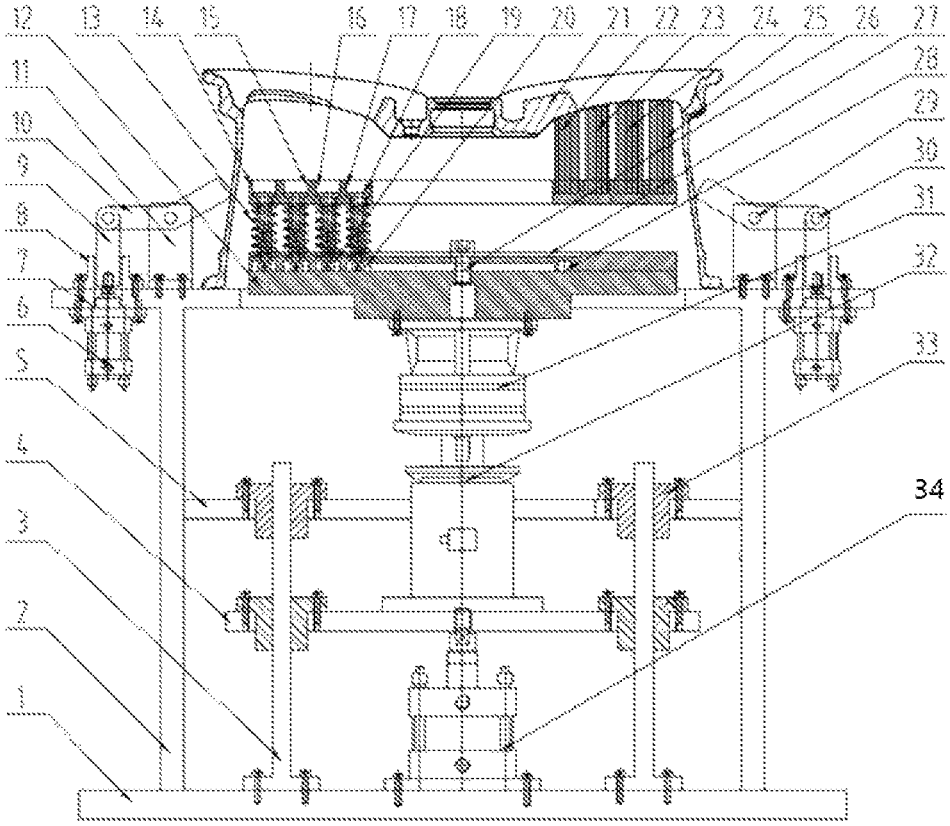
FIG. 1 illustrates a front view of a flexible automatic deburring device according to some embodiments of the present disclosure.

1—base, 2—upright post, 3—first guide post, 4—lifting plate, 5—intermediate plate, 6—first cylinder, 7—base plate, 8—first guide sleeve 1, 9—second guide post, 10—positioning rod, 11—supporting seat, 12—connecting plate, 13—spring, 14—first brush holder, 15—second brush holder, 16—third brush holder, 17—fourth brush holder, 18-positioning post, 19—retaining ring, 20—first screw, 21—wheel, 22—fourth brush, 23—third brush, 24—second brush, 25—first brush, 26—second screw, 27—fixing plate, 28—pin, 29—first rotating shaft, 30—second rotating shaft, 31—speed reducer, 32—motor, 33—second guide sleeve, 34—second cylinder, 35—lightening hole.

DETAILED DESCRIPTION

The technical solution in the embodiments of the present disclosure is clearly and completely described in combination with drawings of the embodiments of the present disclosure below, and obviously, the described embodiments are part of embodiments of the present disclosure rather than all embodiments. Based on the embodiments of the present disclosure, all the other embodiments obtained by those having ordinary skill in the art without any creative works are within the protection scope of the present disclosure.

The terms 'first', 'second', 'third', 'fourth' and the like in the specification and in the claims of the application are used for distinguishing different objects but not for describing a specific sequence. Furthermore, the terms 'comprise' and 'have' as well as their any variations are intended to cover a non-exclusive inclusion. For example, a process, method, system, product or equipment comprising a series of steps or units does not limit steps or units which have been listed, but selectively further comprises steps or units which are not listed, or selectively further comprises other inherent steps or units for the process, method, product or equipment.

Reference in the specification to 'embodiments' of the present disclosure means that a particular feature, structure or characteristic described in connection with the embodiments is included in at least one embodiment of the application. The appearances of the phrase 'the embodiments' in various places in the specification are not necessarily all referring to the same embodiment, nor are separate or alternative embodiments necessarily mutually exclusive of other embodiments. It will be explicitly and implicitly understood by those skilled in the art that the embodiments described in the present disclosure can be combined to other embodiments.

In order to further understand the content, features and functions of the disclosure, the following embodiments are given and illustrated with the attached drawings as follows.

Embodiment One

Embodiment One of the present disclosure will be described below in conjunction with FIGS. 1-4, in which a flexible automatic deburring device is provided. The flexible automatic deburring device comprises a base 1, upright posts 2, first guide posts 3, a lifting plate 4, an intermediate plate 5, first cylinders 6, a base plate 7, first guide sleeves 8, second guide posts 9, positioning rods 10, supporting seats 11, a connecting plate 12, springs 13, a first brush holder 14, a second brush holder 15, a third brush holder 16, a fourth brush holder 17, positioning posts 18, retaining rings 19, first screws 20, a wheel 21, a fourth brush 22, a third brush 23, a second brush 24, a first brush 25, a second screw 26, a fixing plate 27, pins 28, first rotating shafts 29, second rotating shafts 30, a speed reducer 31, a motor 32, second guide sleeves 33, a second cylinder 34, and lightening holes 35.

The four upright posts 2 are symmetrically welded on the base 1, the annular base plate 7 is welded on the four upright posts 2, and the annular intermediate plate 5 is welded at the middle positions of the four upright posts 2; two of the second guide sleeves 33 are symmetrically installed on the intermediate plate 5 through threaded connection, the second cylinder 34 is fixedly installed on the base 1 through threaded connection, and the output end of the second cylinder 34 is installed on the lifting plate 4 through threaded connection; the other two second guide sleeves 33 are symmetrically installed and fixed on the lifting plate 4 through threaded connection, and the two first guide posts 133 respectively pass through the two groups of second guide sleeves 33 and are fixedly installed on the base 1 through threaded connection; and the second guide sleeves 33 are copper sleeves, spiral grooves with a diameter of 3 mm and a pitch of 5 mm are machined in the inner wall of a hole of each copper sleeve, and the friction coefficient between the first guide posts 33 and the second guide sleeves 33 is reduced through grease lubrication, so as to realize a better lubrication effect. The motor 32 penetrates through the intermediate plate 5 and is fixed on the lifting plate 4 through threaded connection, the output end of the motor 32 is provided with the speed reducer 31, and the output end of the speed reducer 31 is installed on the connecting plate 12 through screws; the fixing plate 27 is connected and installed on the connecting plate 12 through the second screw 26 and the pins 28, and the fixing plate 27 and the connecting plate 12 are provided with the symmetrically distributed lightening holes 35, which greatly reduces the overall weight of the equipment; and the lightening holes 35 include but are not limited to the shape shown in FIG. 4. The four positioning posts 18 respectively pass through the first brush holder 14, the second brush holder 15, the third brush holder 16 and the fourth brush holder 17 which are connected and mounted to the fixing plate 27 by the retaining rings 19 and the first screws 20, and the four springs 13 are respectively mounted on the four positioning posts 18; the first brush 25, the second brush 24, the third brush 23 and the fourth brush 22 are respectively fixedly installed in a plurality of round grooves uniformly distributed on the upper surface of the first brush holder 14, a plurality of round grooves uniformly distributed on the upper surface of the second brush holder 15, a plurality of round grooves uniformly distributed on the upper surface of the third brush holder 16, and a plurality of round grooves uniformly distributed on the upper surface of the fourth brush holder 17 by glue, and the fourth brush 22, the third brush 23, the second brush 24 and the first brush 25 are independent of each other; the springs 13 and the positioning posts 18 allow the brushes to float up and down to adapt to hubs with different spoke inner cavity shapes, it is guaranteed that the brushes make contact with spoke inner cavities all the time, in this way, hubs with the same size but different shapes can use the same brush mechanism, and it is unnecessary to prepare brushes suitable for all wheel types. The four first cylinders 6 are symmetrically and evenly installed and fixed on the lower surface of the base plate 7 through threaded connection, the output end of each first cylinder 6 is fixedly provided with a second guide post 9 through threaded connection, and the second guide posts 9 pass through the first guide sleeves 8 fixed on the upper surface of the base plate 7 through threaded connection; the second rotating shafts 30 penetrate through the second guide posts 9 and the positioning rods 10, and the first rotating shafts 29 pass through holes in the middle of the positioning rods 10 and holes in the supporting seats 11 fixedly installed on the upper surface of the base plate 7 through threaded connection; and the eight supporting seats 11 divided into four groups are symmetrically and uniformly installed on the upper surface of the base plate 7, every two supporting seats 11 are symmetrically installed at two ends of the corresponding positioning rod 10, and the wheel 21 is positioned in the middle of the upper surface of the base plate 7. The positioning rods 10 can be used for positioning and clamping the wheel 21 by utilizing the lever principle.

In actual use, the wheel 21 is placed at the central position of the base plate 7 manually or by mechanical hands, the four first air cylinders 6 drive the second guide posts 9 to move vertically upwards under the guidance of the first guide sleeves 8, and simultaneously drive the V-shaped positioning rods 10 to rotate around the first rotating shafts 29, and the four positioning rods 10 position and clamp the wheel 21; and the second air cylinder 34 drives the motor 32 and the speed reducer 31 and the brush mechanism mounted thereon to move upwards integrally through the lifting plate 4, till the fourth brush 22, the third brush 23, the second brush 24 and the first brush 25 are all in contact with an inner cavity of the wheel 21, at this point, the motor 32 drives the connecting plate 12 to rotate through the speed reducer 31, and the connecting plate 12 transmits power to the brush mechanism above through the second screw 26 and the pins 28, to drive the uniformly arranged fourth brush 22, third brush 23, second brush 24 and first brush 25 to rotate while keeping in contact with the inner cavity of the wheel 21, thus removing burrs at a spoke window of the wheel 21.

Embodiment Two

A deburring device comprises a main body support, a lifting assembly, a rotary burr brushing assembly and positioning and clamping assemblies. The main body support comprises a base plate 7, four upright posts 2, an intermediate plate 5 and a base 1, the base plate 7, the intermediate plate 5 and the base 1 are all horizontal, and the four upright posts 2 are symmetrically welded and fixed on the base 1; and the annular base plate 7 is welded at the upper ends of the four upright posts 2, the annular intermediate plate 5 is welded and fixed at the middle positions of the four upright posts 2, a circular hole is formed in the middle of the intermediate plate 5, and the lower end of the rotating assembly passes through the circular hole in the intermediate plate 5. The overall structure of the main body support is circular, which facilitates the position setting of positioning and clamping assemblies and the placement of the wheel hub. The circular design enables the middle lifting assembly and the rotary burr brushing assembly to move up and down to adapt to different wheel rim depths.

The lifting assembly is fixed at the bottom of the main body support, the rotary burr brushing assembly is fixed at the upper end of the lifting assembly, and the lifting assembly can drive the rotary burr brushing assembly to move up and down in the vertical direction to adapt to inner cavities of workpieces with different depths; and the lifting assembly comprises a vertical lifting part and a lifting plate 4, the vertical lifting part is fixed on the base 1 of the main body support through a bolt, the lifting plate 4 is fixed to an output shaft at the upper end of the vertical lifting part through a bolt, and the lifting plate 4 can move up and down inside the main body support under the action of the vertical lifting part. One or more first guide posts 3 are further arranged on the circumference of the vertical lifting part on the base 1, the first guide posts 3 are fixed on the base 1 through bolts, second guide sleeves 33 are fixedly arranged on the lifting plate 4 and the intermediate plate 5 at positions corresponding to the first guide posts 3 through screws, the first guide posts 3 are inserted into the second guide sleeves 33, and the first guide posts 3 and the second guide sleeves 33 move relatively along with the lifting of the vertical lifting part. The vertical lifting part in this embodiment may be an air cylinder, a hydraulic cylinder or an electric cylinder. The arrangement of the first guide posts 3 and the second guide sleeves 33 makes the lifting of the lifting assembly more stable, so that the rotary burr brushing assembly does not deviate and the burr brushing quality is ensured.

Figure 4:
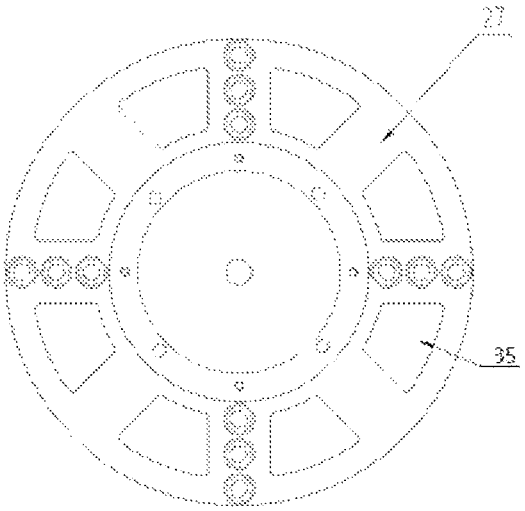
FIG. 4 is a part diagram of a fixing plate of a flexible automatic deburring device according to some embodiments of the present disclosure.

The rotary burr brushing assembly comprises a rotating assembly, a fixing plate 27, springs 13, positioning posts 18, brush holders and brushes, the rotating assembly is fixed at the upper end of the lifting assembly, the fixing plate 27 is fixed at the upper end of the rotating assembly, and the rotating assembly drives the fixing plate 27 to rotate; the rotating assembly comprises a motor 32, a speed reducer 31 and a connecting plate 12, the lower end of the motor 32 is fixed at the upper end of the lifting assembly through a bolt, and the output end of the motor 32 is connected with the speed reducer 31; and the connecting plate 12 is fixedly mounted at the output end of the speed reducer 3, the fixing plate 27 is fixed on the connecting plate 12 through a screw and pins 28, and the motor 32 drives the connecting plate 12 and the fixing plate 27 to rotate through the speed reducer 31. The brushes are fixed in the brush holders by glue, the brush holders are fixed on the fixing plate 27 through the positioning posts 18, and the springs 13 are arranged between the bottom surfaces of the brush holders and the fixing plate 27; and a through hole is formed in the bottom surface of each brush holder, the positioning posts 18 pass through the through holes in the bottom surfaces of the brush holders, the lower ends of the positioning posts 18 are fixed on the bottom surface of the fixing plate 27 through retaining rings 19 and screws, and the parts, positioned between the bottom surfaces of the brush holders and the fixing plate 27, of the positioning posts 18 are sleeved with the springs 13. When the brushes are subjected to pressure, the brush holders move down in the vertical direction and compress the springs 13. One or more groups of brush holders are arranged, each group includes a plurality of brush holders, and the plurality of brush holders of each group are closely arranged in the radial direction of the circumference of the workpiece. The group number of brush holders can be adjusted and set according to the burr brushing effect. In this embodiment, four groups of brush holders are fixed on the fixing plate 27, and the interval between every two adjacent groups of brush holders is 90 degrees. In addition, the fixing plate 27 and the connecting plate 12 are correspondingly and uniformly provided with lightening holes 35, which greatly reduces the overall weight of the equipment, as shown in FIG. 4.

Figure 2:
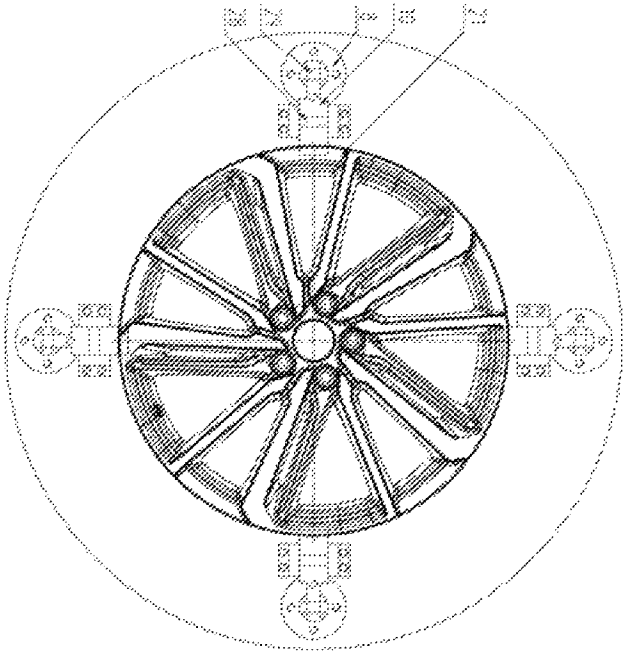
FIG. 2 illustrates a top view of a flexible automatic deburring device according to some embodiments of the present disclosure.
Figure 3:
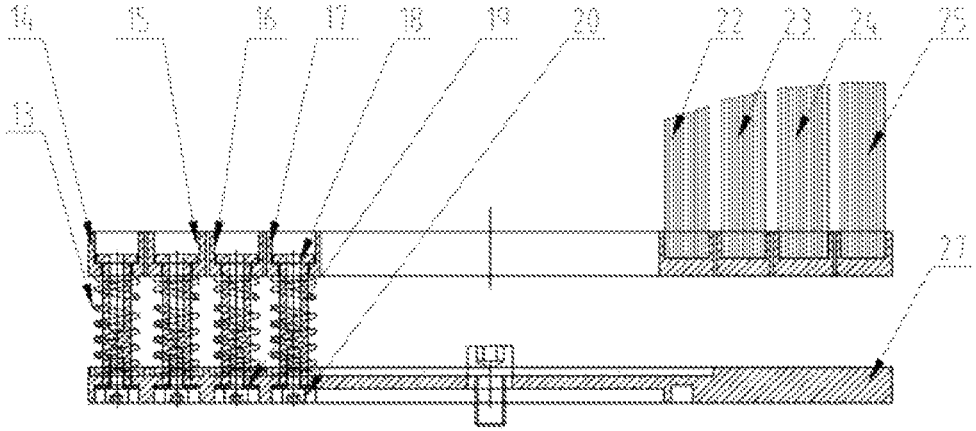
FIG. 3 is a structural schematic diagram of brushes and brush holders of a flexible automatic deburring device according to some embodiments of the present disclosure.

The plurality of positioning and clamping assemblies are uniformly arranged on the top circumference of the main body support, and the positioning and clamping assemblies position the workpiece on the main body support and clamp the workpiece. The positioning and clamping assemblies comprise vertical push-pull assemblies, first guide sleeves 8, second guide posts 9, supporting seats 11, first rotating shafts 29, second rotating shafts 30 and positioning rods 10, and each vertical push-pull assembly can be a common assembly such as an air cylinder, a hydraulic cylinder or an electric cylinder. In this embodiment, the number of the positioning and clamping assemblies is four, as shown in FIG. 2. The vertical push-pull assemblies are fixed on the bottom surface of the base plate of the main body support by screws, the base plate is provided with through holes corresponding to the vertical push-pull assemblies, and output ends of the vertical push-pull assemblies pass through the through holes in the base plate and are connected with the second guide posts 9; the second guide posts 9 are sleeved with the first guide sleeves 8, and the first guide sleeves 8 are fixed on the upper surface of the base plate by screws; the upper ends of the positioning posts 18 are movably connected to one ends of the positioning rods 10 through the second rotating shafts 30, two supporting seats 11 are symmetrically fixed on a top face of the main body support at two sides of the middle of each positioning rod 10, and the first rotating shafts 29 penetrate through the upper portions of the two supporting seats 11 and the middle portions of the positioning rods 10 and movably fix the positioning rods 10 on the two supporting seats 11; when the vertical push-pull assemblies push the second guide posts 9 upwards, the second guide posts 9 push the positioning rods 10 upwards, the positioning rods 10 rotate around the first rotating shafts 29, and the positioning rods 10 fix and clamp the workpiece; and when the vertical push-pull assemblies pull down the second guide posts 9, the second guide posts 9 pull down the positioning rods 10, the positioning rods 10 rotate around the first rotating shafts 29, and the positioning rods 10 release the workpiece. The positioning rods 10 are V-shaped positioning rods 10, and the V-shaped design enables the end, close to the workpiece, of each positioning rod 10 to face upwards, so that the workpiece can be placed and removed more easily; and a through hole is formed at the turning point of the V shape of each positioning rod 10, and the first rotating shafts 29 pass through the through holes in the positioning rods 10 and movably fix the positioning rods 10 on the two supporting seats 11.

According to the deburring device, the lifting assembly can move up and down to adapt to inner cavities of workpieces with different depths, the springs are arranged on the bottom surfaces of the brush holders, so that the brushes can float up and down to adapt to workpieces with different inner cavity shapes, and it is guaranteed that the brushes make contact with the inner cavities of the workpieces all the time; in this way, workpieces with the same size but different shapes can use the same brush mechanism, and it is unnecessary to prepare brushes suitable for all workpieces.

To sum up, the disclosure provides a flexible automatic deburring device, comprising a main body support, a lifting assembly, a rotary burr brushing assembly and positioning and clamping assemblies. The lifting assembly can move up and down to adapt to inner cavities of workpieces with different depths, the springs are arranged on the bottom surfaces of the brush holders, so that the brushes can float up and down to adapt to hubs with different spoke inner cavity shapes, and it is guaranteed that the brushes make contact with spoke inner cavities all the time; in this way, hubs with the same size but different shapes can use the same brush mechanism, it is unnecessary to prepare brushes suitable for all wheel types, thus greatly reducing the workload of replacing deburring brushes, saving the storage space in a workshop and increasing the burr brushing flexibility.

The embodiments of the present disclosure are described in detail above, particular examples are used herein to explain the principle and embodiments of the present disclosure, and the above description of the embodiments is only used to help understanding the methods and core concept of the present disclosure; and meanwhile, for those having ordinary skill in the art, according to the idea of the present disclosure, there will be changes in the specific implementation mode and application scope, in conclusion, the contents of the specification shall not be construed as a limitation of the present disclosure.

What is claimed is:

1. A deburring device, comprising:

a main body support, a lifting assembly, and a rotary burr brushing assembly and positioning and clamping assemblies, wherein:

the lifting assembly is fixed at a bottom of the main body support, the rotary burr brushing assembly is fixed at an upper end of the lifting assembly, and the lifting assembly can drive the rotary burr brushing assembly to move up and down in the vertical direction to adapt to inner cavities of workpieces with different depths;

the rotary burr brushing assembly comprises: a rotating assembly, a fixing plate, springs, brush holders and brushes, the rotating assembly is fixed at the upper end of the lifting assembly, the fixing plate is fixed at the upper end of the rotating assembly, and the rotating assembly drives the fixing plate to rotate; the brushes are fixed in the brush holders, the brush holders are fixed on the fixing plate, and the springs are arranged between bottom surfaces of the brush holders and the fixing plate; when the brushes are subjected to pressure, the brush holders move down in the vertical direction and compress the springs; one or more groups of brush holders are arranged, each group includes a plurality of brush holders, and the plurality of brush holders in each group are closely arranged in the radial direction of the circumference of a workpiece;

the plurality of positioning and clamping assemblies are uniformly arranged on the top circumference of the main body support, and the positioning and clamping assemblies are configured to position the workpiece on the main body support and clamp the workpiece; and the rotary burr brushing assembly further comprises: positioning posts, a through hole is formed in the bottom surface of each brush holder, the positioning posts pass through the through holes in the bottom surfaces of the brush holders, the lower ends of the positioning posts are fixed on the fixing plate, and parts of the positioning posts, positioned between the bottom surfaces of the brush holders and the fixing plate, are sleeved with the springs.

2. The deburring device according to claim 1, wherein:

the rotating assembly comprises: a motor, a speed reducer and a connecting plate, the lower end of the motor is fixed at the upper end of the lifting assembly, and the output end of the motor is connected with the speed reducer; the connecting plate is fixedly mounted at the output end of the speed reducer, the fixing plate is fixed on the connecting plate, and the motor drives the connecting plate and the fixing plate to rotate through the speed reducer.

3. The deburring device according to claim 2, wherein the fixing plate and the connecting plate are correspondingly and uniformly provided with lightening holes.

4. The deburring device according to claim 1, wherein the lifting assembly comprises: a vertical lifting part and a lifting plate, the vertical lifting part is fixed on the bottom of the main body support, the lifting plate is fixed to the upper end of the vertical lifting part, and the lifting plate can move up and down inside the main body support under the action of the vertical lifting part.

5. The deburring device according to claim 1, wherein the main body support comprises: a base plate, four upright posts, an intermediate plate and a base, the base plate, the intermediate plate and the base are all horizontal, and the four upright posts are symmetrically fixed on the base; and an annular base plate is fixed at the upper ends of the four upright posts, an annular intermediate plate is fixed at the middle positions of the four upright posts, a circular hole is formed in the middle of the intermediate plate, and the lower end of the rotating assembly passes through the circular hole in the intermediate plate.

6. The deburring device according to claim 5, wherein the lifting assembly comprises: a vertical lifting part and a lifting plate, the vertical lifting part is fixed on the base of the main body support, the lifting plate is fixed to the upper end of the vertical lifting part, and the lifting plate can move up and down inside the main body support under the action of the vertical lifting part.

7. The deburring device according to claim 6, wherein: one or more first guide posts are further arranged on the circumference of the vertical lifting part on the base; second guide sleeves are arranged on the lifting plate and the intermediate plate at positions corresponding to the first guide posts; the first guide posts are inserted into the second guide sleeves; and the first guide posts and the second guide sleeves move relatively along with the lifting of the vertical lifting part.

8. The deburring device according to claim 1, wherein the positioning and clamping assemblies comprise:

vertical push-pull assemblies, first guide sleeves, second guide posts, supporting seats, first rotating shafts, second rotating shafts, and positioning rods, the vertical push-pull assemblies are fixed on the bottom surface of a top face of the main body support, the top face is provided with through holes corresponding to the vertical push-pull assemblies, and output ends of the vertical push-pull assemblies pass through the through holes in the top face and are connected with the second guide posts;

the second guide posts are sleeved with the first guide sleeves, and the first guide sleeves are fixed on the upper surface of the top face;

the upper ends of the positioning posts are movably connected to one ends of the positioning rods through the second rotating shafts, two supporting seats are symmetrically fixed on the top face of the main body support at two sides of the middle of each positioning rod, and the first rotating shafts penetrate through the upper portions of the two supporting seats and the middle portions of the positioning rods and movably fix the positioning rods on the two supporting seats; and when the vertical push-pull assemblies push the second guide posts upwards, the second guide posts push the positioning rods upwards, the positioning rods rotate around the first rotating shafts, and the positioning rods fix and clamp the workpiece; and when the vertical push-pull assemblies pull down the second guide posts, the second guide posts pull down the positioning rods, the positioning rods rotate around the first rotating shafts, and the positioning rods release the workpiece.

9. The deburring device according to claim 8, wherein the positioning rods are V-shaped positioning rods, a through hole is formed at the turning point of the V shape of each positioning rod, and the first rotating shafts pass through the through holes in the positioning rods and movably fix the positioning rods on the two supporting seats.

10. The deburring device according to claim 1, wherein four groups of brush holders are fixed on the fixing plate, and the interval between every two adjacent groups of brush holders is 90 degrees.

* * * * *